United States Patent [19]

Kaller et al.

[11] Patent Number: 5,027,073

[45] Date of Patent: Jun. 25, 1991

[54] HIGH VOLTAGE IGNITION SYSTEM MONITORING CIRCUIT

[75] Inventors: Ernst Kaller, Tamm; Karl-Heinz Kugler, Vaihingen; Christian Zimmermann, Ingersheim; Hans Koehnle, Schwieberdingen, all of Fed. Rep. of Germany

[73] Assignee: Robert Bosch GmbH, Stuttgart, Fed. Rep. of Germany

[21] Appl. No.: 486,786

[22] Filed: Mar. 1, 1990

[30] Foreign Application Priority Data

Mar. 25, 1989 [DE] Fed. Rep. of Germany ..... 3909906

[51] Int. Cl.[5] ..... F02P 17/00

[52] U.S. Cl. ..... 324/388; 324/399

[58] Field of Search ..... 324/388, 546, 399; 361/253

[56] References Cited

U.S. PATENT DOCUMENTS

| | | | |
|---|---|---|---|
| 4,331,921 | 5/1982 | Walker | 324/388 |
| 4,404,616 | 9/1983 | Miyanaka et al. | 361/253 |
| 4,418,375 | 11/1983 | Ober | 361/253 |
| 4,449,100 | 5/1984 | Johnson et al. | 324/388 |
| 4,742,306 | 5/1988 | Everett et al. | 324/388 |
| 4,851,766 | 7/1989 | Shiobara et al. | 324/546 |
| 4,918,389 | 4/1990 | Schleupen et al. | 324/388 |

*Primary Examiner*—Kenneth Wieder
*Assistant Examiner*—Maura K. Regan
*Attorney, Agent, or Firm*—Frishauf, Holtz, Goodman & Woodward

[57] ABSTRACT

In order to protect catalytic converters from damage caused by continued engine operation with a malfunctioning ignition system, a monitoring circuit checks current in the ignition coil primary winding. Primary winding current (i) is transformed by a measuring circuit (11) into a test primary voltage ($U_{pr}$) which is fed to an evaluation circuit for comparison with ignition system supply voltage ($U_v$) from the battery. During each primary current pulse, an instantaneous value is sampled, preferably during the earlier half of the pulse, and when the instantaneous test voltage ($U_{pr}$) exceeds the supply voltage ($U_v$) by more than a predetermined amount, the evaluation circuit (10) generates an error or malfunction indication. The ignition system can then be serviced before the catalytic converter is ruined.

5 Claims, 3 Drawing Sheets

Fig. 1
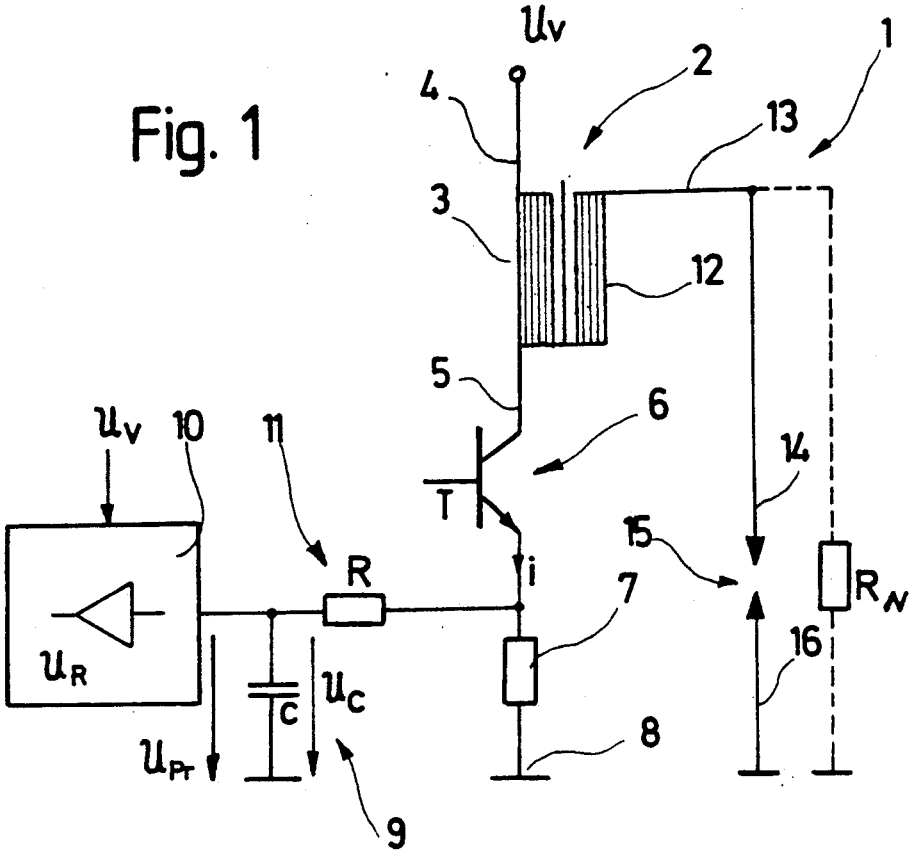
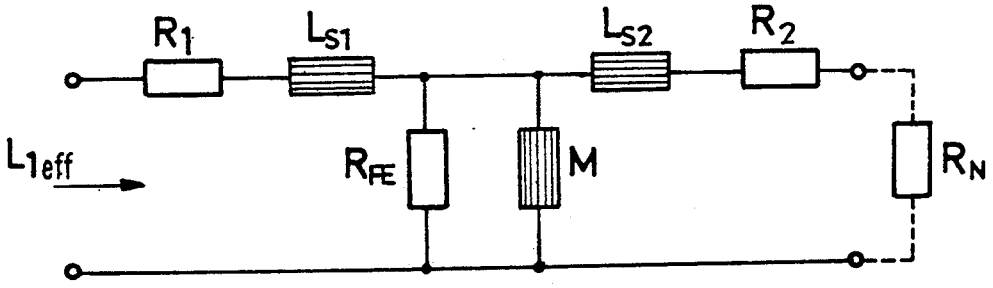
EQUIVALENT COIL CIRCUIT DIAGRAM
Fig. 2

| $R_N$ [kΩ] | $\frac{U_{Pr}}{U_{Pr\,max}}$ [%] | | | | |
|---|---|---|---|---|---|
| | $t_1$ | $t_2$ | $t_3$ | $t_4$ | $t_5$ |
| ∞ | 13 | 21 | 43 | 72 | 94 |
| 500 | 15 | 23 | 43 | 72 | 94 |
| 100 | 21 | 30 | 47 | 72 | 94 |
| 0 | 75 | 85 | 89 | 96 | 98 |

Fig. 7

HIGH VOLTAGE IGNITION SYSTEM MONITORING CIRCUIT

Cross-reference to commonly assigned related patent documents, the disclosures of which are hereby incorporated by reference: SCHLEUPEN et al. application U.S. Ser. No. 07/239,797, filed Sept. 1, 1988, now U.S. Pat. No. 4,918,389, issued Apr. 17, 1990; DENZ et al. application U.S. Ser. No. 07/453,403, filed Dec. 19, 1989, now U.S. Pat. No. 4,995,365, issued Feb. 26, 1991.

FIELD OF THE INVENTION

The present invention relates generally to monitoring circuits for motor vehicle ignition systems and, more particularly, to a circuit which detects excess ignition coil primary winding current, indicative of a short-circuit, using an R-C series detector and a downstream voltage comparator, and generates a malfunction indication to warn the vehicle operator.

BACKGROUND

In order to minimize the polluting components of emissions from the internal combustion engine of motor vehicles and the like, the installation of a catalytic converter is necessary. The efficiency and service life of such a converter depends significantly upon the proper functioning of the engine. In the event that malfunctions occur, for example in the high voltage ignition system, this can lead to operating conditions which overload the catalytic converter.

THE INVENTION

Accordingly, it is an object of the present invention to detect malfunctions or defects in the ignition system arising from leakages and/or short circuits in the secondary winding of the ignition coil, in the ignition wiring harness, or in the sparkplugs, so that timely corrective actions can be taken. Protection of the catalytic converter is thereby achieved with the circuit of the present invention.

Briefly, this is accomplished by deriving, from the primary winding current, a corresponding test voltage, and comparing the test voltage with the supply voltage of the ignition system to obtain an indication of the condition of the ignition system.

If leakages and/or short circuits occur in the secondary circuit, this leads, due to the magnetic coupling between the secondary and primary sides of the ignition coil, to a reduction in its effective primary inductivity, so that a faster rise of the primary current (ignition coil charging current) occurs. The primary current rise is detected by the measuring circuit and causes a faster rise in the test voltage. Compared to an defect-free ignition system, there is a shifting of the relation between test voltage and supply voltage, leading to generation of a malfunction indication.

According to another feature of the invention, the measuring circuit includes a shunt in the primary current path of the ignition coil. The voltage across the shunt element represents a measure of the primary current which occurs in each ignition cycle.

Preferably, there is provided, connected in parallel to the shunt element, a filter circuit formed by a series circuit of a resistance and a capacitor. The voltage across the capacitor forms the test voltage used for monitoring the ignition system.

The comparison of the test voltage with the supply voltage assures that primary current changes caused by supply voltage fluctuations do not lead to a malfunction indication. For example, supply voltage may fluctuate according to the charge condition of the vehicle battery and according to the setting of the voltage regulator. These could lead to "false positive" malfunction indications if the circuit did not automatically compensate for such fluctuations, which the invention does.

A particularly simple measurement evaluation is possible by using a comparator in the evaluation circuit, to which are fed the test voltage and the supply voltage. If the test voltage exceeds the supply voltage by a predetermined amount, it follows that there is a leakage or short-circuit malfunction or defect in the ignition system.

Preferably, for voltage comparison purposes, the evaluation circuit adopts a reference value corresponding to the supply voltage. For error evaluation, the height of the test voltage is compared against the size of the reference value. If one calculates from the battery voltage, then a reference value corresponding to the battery voltage of the motor vehicle is used for the monitoring.

According to a further feature of the invention, for purposes of the voltage comparison, the evaluation circuit samples at least an instantaneous value of the test voltage. To determine this instantaneous value, on e must sample the voltage rise of the test voltage at a correspondingly chosen instant. The temporal position of this instantaneous value, with respect to the duration of the whole primary current pulse, preferably lies in the first, earlier half of the primary current pulse, since errors arising from leakages and/or short circuits manifest themselves particularly in the first half of the test voltage rise, corresponding to the primary current course or trace.

Depending upon the configuration, structure, or type of the ignition system installed, the region, within the length of a primary current pulse, which is representative for error recognition can vary, so it is advantageous to select the temporal position of the instantaneous value of the test voltage as a function of, or in dependence upon, the particular ignition system which is installed.

The monitoring is particularly simplified, if the evaluation circuit generates the error indication whenever the comparison indicates that the instantaneous value exceeds the reference value. In that case, the monitoring can be carried out simply using a comparator.

Besides the aforementioned defect or error indication, it is possible, instead or in addition, to disable the ignition system in the even of an impermissible or overloading operating state.

DRAWINGS

FIG. 1 is a schematic circuit diagram of the circuit of the present invention;

FIG. 2 is an equivalent circuit diagram of an ignition coil which has a leakage or short circuit;

FIG. 7 is a table of measured values relating to the test voltage rise curves illustrated in FIGS. 3–6.

Figure 3:
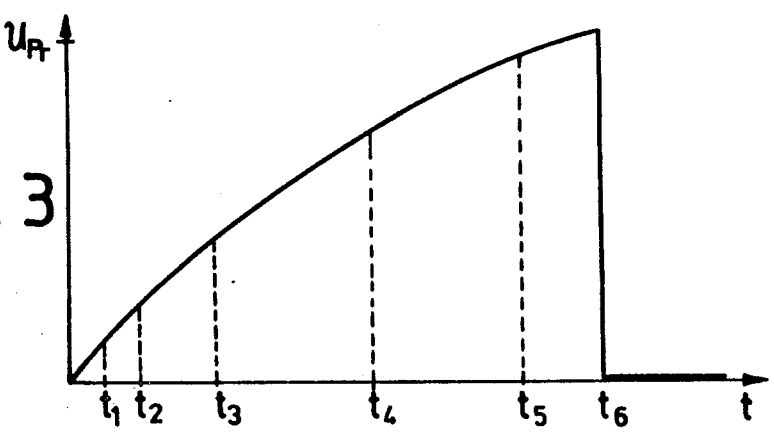
FIG. 3 is a graph of test voltage versus time in a properly functioning ignition coil.

DETAILED DESCRIPTION:

FIG. 1 illustrates schematically the circuit of the present invention for monitoring a high voltage ignition system of an internal combustion engine of a motor vehicle, tractor, lawnmower, snowblower, woodchipper, or the like. The monitoring is intended to detect leakages and/or short circuits on the secondary side 1 of an ignition coil 2.

Coil 2 has a primary winding 3 with a first end 4 which is connected to a vehicle supply voltage $U_v$, such as a car battery. The other or second end 5 of primary winding 3 is connected to a breaker switch 6, which in turn is connected via a shunt 7 to ground 8. The other pole of the supply voltage $U_v$ is also connected to ground; preferably, this is the chassis of the motor vehicle.

The breaker is preferably a transistor T as shown. Its base is controlled by a control circuit (not shown) of a control device of the high voltage ignition system. Such devices are disclosed in numerous prior Bosch patents. The transistor's collector-emitter path is connected in the primary current path of primary winding 3.

Connected in parallel to shunt element 7 is a filter circuit 9 which is a series circuit of a resistance R and a capacitor C. The resistance-remote end of the capacitor is grounded. The voltage $U_c$ across capacitor C is used as test primary voltage $U_{pr}$. This test voltage $U_{pr}$ is fed to an evaluation circuit 10.

Shunt element 7 forms, together with resistance R and capacitor C, a measuring circuit 11 which converts the primary current i flowing through primary winding 3 of ignition coil 2 into corresponding test voltage $U_{pr}$.

Supply voltage or vehicle battery voltage $U_v$ is also fed to evaluation circuit 10. Circuit 10 derives a reference value $U_R$ corresponding to the supply voltage or battery voltage $U_v$.

Secondary winding 12 of ignition coil 2 has a high voltage terminal 13 which is connected to a first electrode 14 of a sparkplug 15. The other electrode 16 is connected to ground 8.

Defects or errors arising from leakages or short circuits of secondary winding 12, of the ignition wiring harness (leads to the sparkplugs and the like) and/or of sparkplug 15, can be detected and represented by a leakage resistance $R_N$, as shown by the phantom lead on the right side of FIG. 1.

FIG. 2 is a schematic equivalent of ignition coil 2 of FIG. 1, and illustrates how secondary-side leakages or short circuits lead, via the coupling of the secondary and primary sides of ignition coil 2, to reduction of the effective inductance $L_{1\,eff}$. The equivalent circuit consists of effective resistance $R_1$ of the primary side, which is series-connected to a stray inductance $L_{s1}$. To this is connected a resistance $R_{FE}$ representing the ferrous core losses and, parallel thereto, a transverse inductance M. The secondary side is represented in the equivalent diagram by stray inductance $L_{s2}$ and effective resistance $R_2$, connected in series.

Leakages and/or short circuits which occur are represented by resistance $R_N$, again connected by phantom leads. This makes clear that, depending upon the magnitude of resistance $R_N$ the effective primary inductance $L_{1\,eff}$ changes. As resistance $R_N$ becomes smaller, so does effective primary inductance $L_{1\,eff}$. The reduced inductance leads to a faster rise of primary current i.

Figure 5:
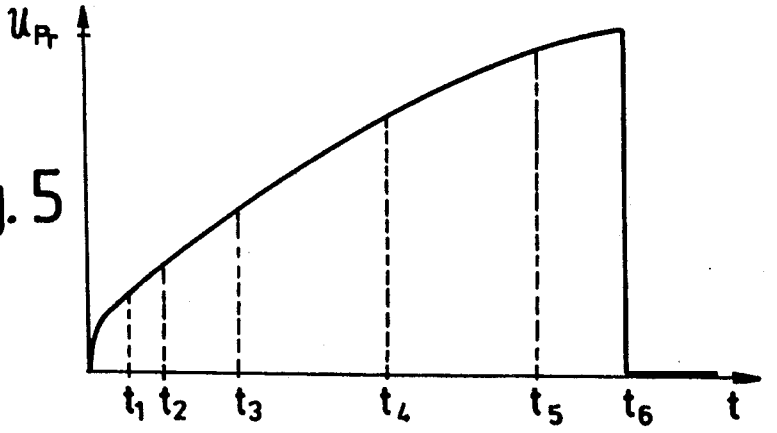
FIG. 5 is a graph of test voltage versus time in an ignition coil with a 100 kilo-Ohm leakage.
Figure 4:
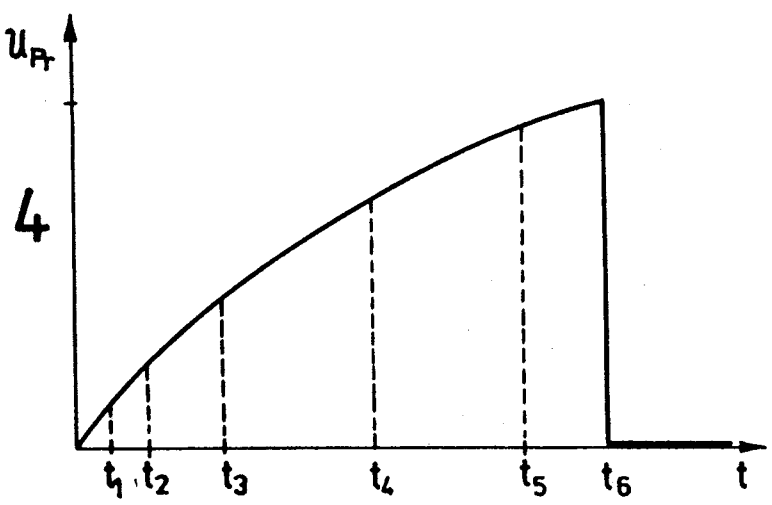
FIG. 4 is a graph of test voltage versus time in an ignition coil with a 500 kilo-Ohm leakage.
Figure 6:
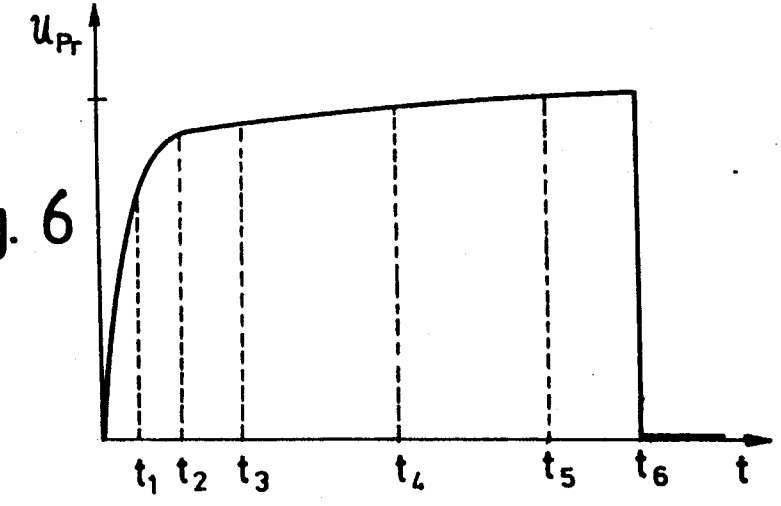
FIG. 6 is a graph of test voltage versus time in an ignition coil with a short circuit.

FIGS. 3 through 6 each illustrate the temporal trace or course of test voltage $U_{pr}$, corresponding to a primary current pulse, for various values of $R_N$. FIG. 3 illustrates a properly functioning high voltage ignition system, that is, the resistance $R_N$ is infinite (a first range limiting case). FIG. 4 shows the trace for resistance $R_N$ equal to 500 kilo-Ohms. The resistance value in FIG. 5 is 100 kilo-Ohms and FIG. 6 represents the other limiting case of a short circuit, that is, resistance $R_N$ has the value 0.

From FIGS. 3 through 6, it can be seen that the course of test voltage $U_{pr}$ is dependent upon the value of resistance $R_N$. Time instants $t_1$ through $t_6$ are marked on each graph, and the measured voltage values generally are correspondingly different in the respective figures.

FIG. 7 is a measured value table illustrating this. For each of instants $t_1$ through $t_5$, the instantaneous voltage value $U_{pr}$ is stated as a percentage of the maximum voltage value $U_{pr}$ max ($U_{pr}$ at time instant $t_6$). The relation is given in percentages for values of $R_N$ infinite, 500 kilo Ohms, 100 kilo Ohms, and 0.

It is apparent that, with reduction of resistance $R_N$, i.e., with increase in the effectiveness of the leakage or short circuit defect, a rise of the percentage values occurs. It is further apparent that the strongest changes occur in the first, earliest half of the test voltage pulse and primary current pulse, while in the second, later half (instants $t_4$ and $t_5$), the values do not differ whether $R_N$ is infinite, 500 kilo Ohms or 100 kilo Ohms. Therefore, it is advantageous for the evaluation of the test voltage $U_{pr}$ to be performed in the the first, earlier, half of the voltage trace shown in FIGS. 3–6.

For purposes of defect or error recognition, preferably at least an instantaneous value is taken by sampling at a preselected time instant of the test voltage trace. The sampling takes place —for reasons explained above —in the first, earlier half of the pulse. Since the thus-sampled instantaneous value of test voltage $U_{pr}$ depends upon the magnitude of the supply voltage $U_v$ or battery voltage, one uses as the comparison potential the supply or battery voltage which pertains at the instant of the sampling. If the test voltage $U_{pr}$ exceeds a value derived from the magnitude of the supply or battery voltage, a leakage or short circuit defect is present on the secondary side 1 of the high voltage ignition system, which leads to release of a malfunction indication.

It is particularly advantageous if the evaluation circuit 10 forms a reference value corresponding to the supply or battery voltage, which reference value is then used for the voltage comparison with test voltage $U_{pr}$.

This voltage comparison can be performed particularly simply using a comparator in the evaluation circuit 10; a defect exists whenever the test voltage $U_{pr}$ is greater than reference voltage $U_R$.

The monitoring circuit of the present invention represents an effective measure for catalytic converter protection. When ignition system defects occur, clean burning of the fuel is no longer assured. Unburnt hydrocarbons from the engine are combusted in a catalytic converter, which necessarily generates heat. It clear that prolonged operation of an engine emitting unburnt hydrocarbons will impose a load on the catalytic converter beyond its design limits, and will sooner or later lead to damage and/or premature failure. This is a public safety matter, too, since overheated converters have been known to cause the entire vehicle to ignite and burn.

Various changes to the above-described preferred embodiment are possible within the scope of the inventive concept.

We claim:

1. Circuit for monitoring a high voltage ignition system, of an internal combustion engine of a motor vehicle having an ignition coil (2) with primary (3) and secondary (12) windings and a series circuit, formed by said ignition coil primary winding (3) and a breaker switch (5), connected to a supply voltage ($U_v$), against short circuits, comprising a measuring circuit (11), having an input tapping said series circuit, which transforms current (i) in said ignition coil primary winding (3) into a test primary voltage ($U_{pr}$), and an output, said measuring circuit (11) including a shunt element (7) connected in a primary current path of said ignition coil (2); and an evaluation circuit (10) including a comparator having a first input connected to said output of said measuring circuit (11) to thereby receive said test primary voltage ($U_{pr}$) and a second input connected to said supply voltage ($U_v$), comparing said test primary voltage ($U_{pr}$, with said supply voltage ($U_v$) by defining a reference value ($U_R$) corresponding to said supply voltage ($U_v$) and sampling at least an instantaneous value of said test voltage ($U_{pr}$), and generating an error signal whenever said sampled test voltage exceeds said supply voltage by a predetermined amount.

2. Circuit according to claim 1, wherein said measuring circuit (11) includes, connected in parallel to said shunt element (7), a filter circuit (9) formed by connecting in series a resistor (R) and a capacitor (C), and wherein voltage across said capacitor ($U_c$) is defined as said test primary voltage ($U_{pr}$).

3. Circuit according to claim 1 wherein the instant for sampling said instantaneous value is selected, with reference to the duration of a primary current pulse, to be within an earliest half of said primary current pulse.

4. Circuit according to claim 3, wherein said sampling instant is selected as a function of the configuration of the high voltage ignition system.

5. Circuit according to claim 1, wherein said evaluation circuit (10) generates an error signal when said instantaneous value exceeds said reference value ($U_R$).

* * * * *